United States Patent [19]

Selwyn et al.

[11] 4,451,158

[45] May 29, 1984

[54] COUNTDOWN TIMER

[75] Inventors: Stephen Selwyn, Queens, N.Y.; William P. Ketcham, 47 Sinawoy Rd., Cos Cob, Conn. 06807

[73] Assignee: William P. Ketcham, Cos Cob, Conn.

[21] Appl. No.: 459,371

[22] Filed: Jan. 20, 1983

[51] Int. Cl.[3] ..... G04B 21/08; G04C 21/14

[52] U.S. Cl. ..... 368/63; 368/89; 368/107; 368/109

[58] Field of Search ..... 368/63, 89, 107–109, 368/113, 118, 119, 120, 121

[56] References Cited

U.S. PATENT DOCUMENTS

| | | | |
|---|---|---|---|
| 3,581,410 | 2/1969 | Zeigner et al. | 35/39 |
| 4,266,096 | 5/1981 | Inoue et al. | 179/1.5 M |
| 4,405,241 | 9/1983 | Aihara et al. | 368/63 |
| 4,421,416 | 12/1983 | Hashimoto et al. | 368/63 |

FOREIGN PATENT DOCUMENTS

| | | | |
|---|---|---|---|
| 56-18785 | 2/1981 | Japan | 368/63 |
| 7156578 | 9/1982 | Japan | 368/63 |

*Primary Examiner*—Bernard Roskoski

*Attorney, Agent, or Firm*—Mandeville & Schweitzer

[57] ABSTRACT

A countdown timer designed for counting down predetermined intervals of time and periodically announcing the progressive elapse of the countdown period thru the use of a voice synthesizer. The time interval between the spoken announcements is decreased as the end of the period approaches. An automatic restart period is incorporated which recycles to a predetermined time to begin the countdown again the number of the restart cycle being counted down is displayed.

9 Claims, 3 Drawing Figures

COUNTDOWN TIMER

BACKGROUND OF THE INVENTION

Talking timing devices, per se, are known to the art and earlier descriptions of such devices may be found in the patent literature. See U.S. Pat. Nos. 3,581,410 and 4,266,096, for example. In general, it is to improvements in "talking timers" that the present invention is directed and, in particular, it is to a new and improved talking countdown timer to which the patent claims herein are directed.

The present invention relates specifically to a new and improved countdown timer having a digitally displayed and "vocally," audibly annunciated output of time remaining in a selected countdown period. The new timer is formed as a dedicated micro-computer having sufficient voice synthesizing capacity and programming to provide syntesized vocal equivalents of the displayed countdown time at predetermined intervals during the countdown. For example, the synthesized speech equivalent of the displayed time may be provided at whole minute intervals during the initial phases of the countdown; at 15 second intervals during the penultimate phases of the countdown, and at one second intervals during the final countdown to a zero time base datum.

SUMMARY OF THE PRESENT INVENTION

The countdown timer of the present invention is specially designed for counting down predetermined intervals of time, while periodically annunciating the progressive elapse of the counting down period with synthetic speech, while decreasing the time interval between the "spoken" annoucements of the time remaining as the end of the counting down period approaches. As a more specific aspect of the invention, an automatic "restart period" is incorporated, which functions as follows: upon the termination of the initial selected countdown period and continuously thereafter upon the completion of each successive "restart period," the countdown timer recycles to a pre-determined time and resumes counting down. Associated with the "restart" feature of the countdown timer is a register which keeps track of the number of times the counter has been in a "restart" mode and a visual display indicating the actual number of the "restart" cycle being counted down when the unit is in its "restart" mode.

The timer of the present invention has particular utility with events in which it is necessary to coordinate with precision a particular activity with a counted down time and/or a counted down time extended by a pre-determined "restart" period such as, for example, in the coordination of yacht position with a starting line at the start of a yacht race. Typically, in yachting a pre-start time signal (cannon fire) is given to indicate that the race will start at a predetermined time thereafter. Yachtsmen then must coordinate the position of their vessels to the starting line so as to approach the line, but not cross the line, at the very end of the counted down period. In some cases, it is necessary to delay the start of the race by a predetermined interval, a "general recall" period, in which event the start of the race time is postponed automatically to a predetermined later "restart" time, for example, five minutes later than the original start time. As will be appreciated, the countdown timer of the present invention is ideally suited for use by yachtsmen and others who require both visual and audible signals representing the elapse of a predetermined period of time and/or the elapse of a predetermined period of time as continually extended by one or more predetermined "restart" periods.

For a more complete understanding of the present invention and a better appreciation of its attendant advantages, reference should be made to the following detailed description of the invention taken in conjunction with the accompanying drawings, a description of which follows:

DETAILED DESCRIPTION OF THE PRESENT INVENTION

Figure 1:
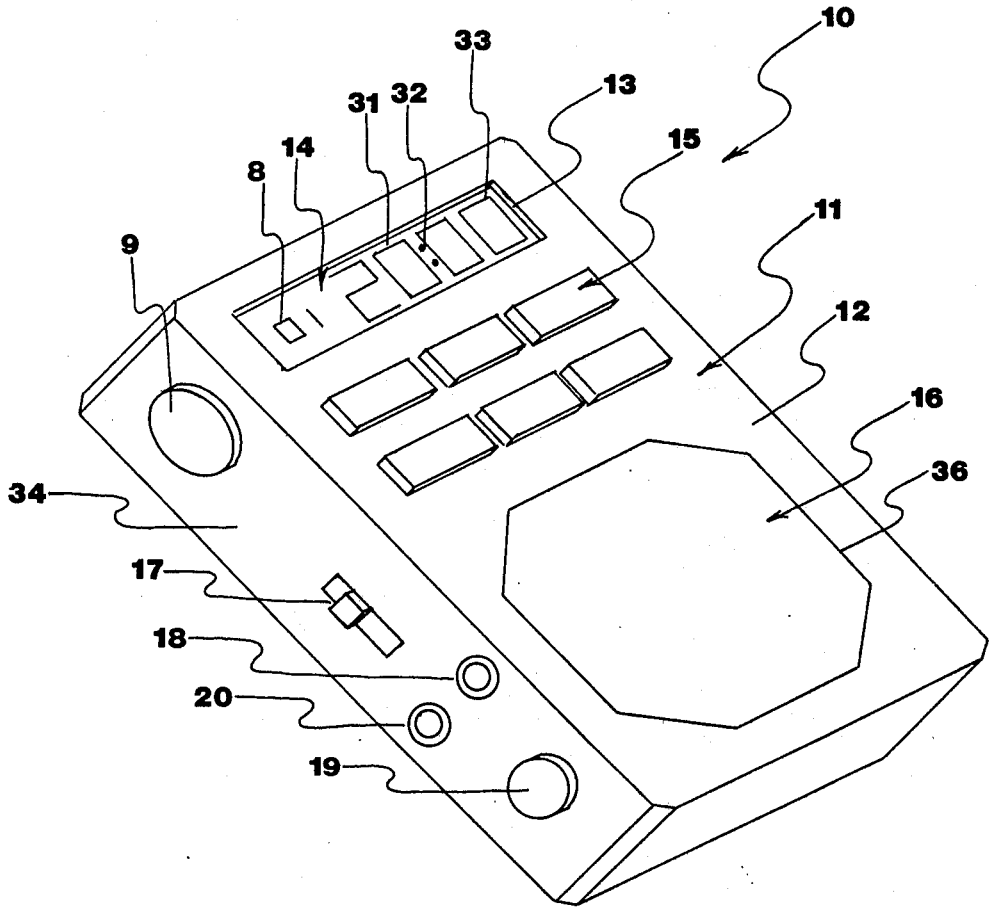
FIG. 1 is a perspective view of a first embodiment of a miniaturized countdown timer assembled in a housing and embodying the principles of the present invention.

Referring now to FIG. 1, the new countdown timer 10 includes a compact housing 11 made of a waterproof, shock-resistant thermoplastic material, such as polycarbonate or other suitable material. The front wall 12 of the housing 11 includes a window 13 through which a digital time display 14, comprising minute digits 31, a colon 32, and second digits 33, is exposed; a series of pushbuttons 15 for selecting countdown programs or performing a clear function; and a speaker grille 16 sealed by an impermeable, second conductive membrane 36 through which synthesized vocal sounds are emitted to the user. A sidewall of the housing 11 includes a protruding start button 9 for initiating the countdown of a pre-selected time period in a manner to be described in greater detail hereinafter and an on/off button 17. It is to be understood that other means of selecting programs rather than buttons may be employed, e.g. rotary stepping switch; a multi-position switch; or the like, and such components are illustrated in FIG. 3. Also included in sidewall 34 or at other accessible locations on the housing are an external speaker jack 18; a simple volume control knob 19; and a separate jack 20 for external power and/or recharging of an internal battery (indicated at 45 in FIG. 2).

Figure 2:
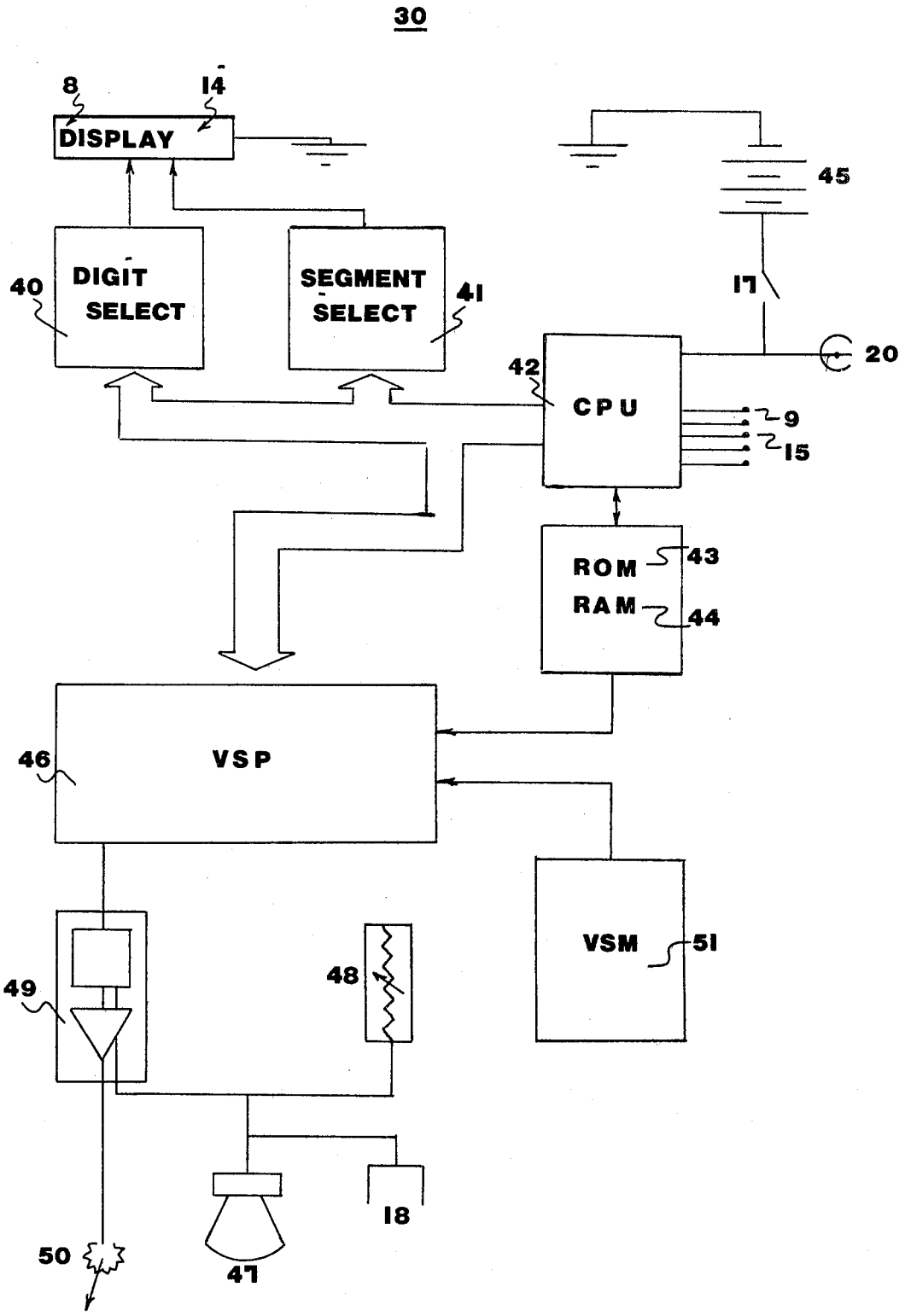
FIG. 2 is a schematic diagram showing the interrelationship of the physical components of a preferred embodiment of the present invention.
Figure 3:
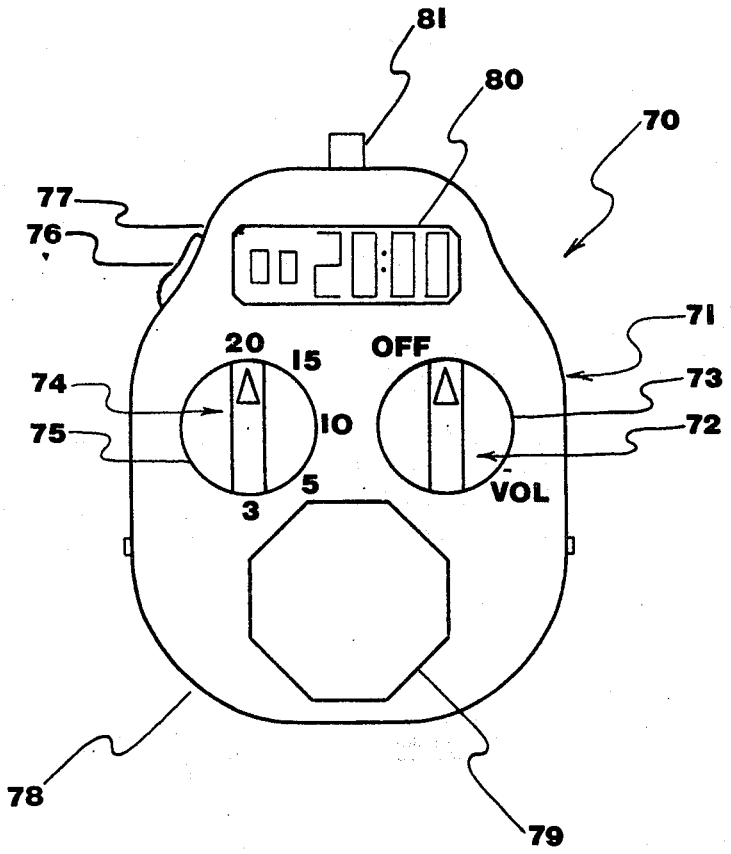
FIG. 3 is a front elevational view of an alternative embodiment of the invention.

Referring now to FIG. 2, the internal structure of the countdown timer 10 is, in accordance with the principles of the present invention, fabricated as dedicated micro-computer 30 having an assemblage of interrelated electronic components suitably associated and mounted on a suitable printed circuit board. The micro-computer 30 includes a digitized electronic readout display 14 in the nature of a six digit LCD display having two "minute digits" 31; a colon 32; two "second digits" 33; and two "recall count" digits 8 or other suitable digitized displays such as an LED display also may be used. The LCD display 14 exhibits the current value of counting down time from a pre-determined starting period of for example, three minutes, five minutes, ten minutes, or twenty minutes. The display time is continuously shown in minutes and seconds starting from 20:00 down to 00:00. Preceding the minute and second digits is a separate two digit "recall" register 8 indicating the number of "recalls", if any, that have taken place. A "recall" is a restart of the countdown immediately after time zero has been reached, commencing a new five minute interval. During an initially selected countdown period, the recall register 8 will indicate zero; after the initial countdown period has reached zero the recall register 8 will indicate "01" as the timer then counts down from five minutes to zero; after the first recall the countdown timer will again automatically count down a second five minute period of time and the recall register 8 will indicate "02" to inform the user that the timer is in its second cycle of the recall mode.

The digital display 14 is driven by suitable integrated circuits 40,41, which power and display the digit segments as required. The specific instantaneous signal delivered to the integrated circuitry 40,41 is generated in a CPU (central processing unit) 42, for example, a Z80L which is available from Zilog, Inc., Cupertino, Calif.

The CPU 42 receives an input from a pre-programmed ROM (Read Only Memory) device 43, such as a 2716 EPROM and a RAM (Random Access Memory) device 44 such as 2114L-4. The power to the CPU 42 is provided by a miniaturized internal DC battery 45, which is wired to the CPU through an on/off switch 17. The jack 20 is also wired into the CPU as shown to provide an alternative source of energizing the micro-computer circuitry 30. As shown in FIG. 2, the "select" push buttons 15 for each of the finite countdown programs are directly wired to the CPU 42.

The output of the CPU 42 is, as indicated in FIG. 2, used not only to drive the digit select and segment select circuitry 40,41 for generating a continuously displayed digital countdown but is also used for driving at pre-determined programmed intervals a VSP (voice synthesizer processor) 46, for example, a TMS 5200 available from Texas Instruments, Dallas, Tex. The VSP 46 generates synthesized vocal sounds corresponding to actual time being counted down. The output of the VSP 46 is appropriately delivered to a local speaker 47 through a pitch control means 48 and a combination filter-amplifier means 49 such as an LM 386. A simple adjustable volume control means 50 is included in the voice synthesizing circuitry for selectively controlling the loudness of the generated synthetic speech. In addition, the loudspeaker circuit includes an output jack 18 which may be used with an external speaker should one be required or necessary for a particular countdown application. The VSP 46 also receives input from a VSM (voice synthesis memory) 51, actually a ROM device having the appropriate speech parameters stored in a suitably encoded form, i.e. the electrically coded signals for the sounds, e.g. "one, two, three", etc. through "fifty", as well as "AM, PM", etc.

In use, the new and improved countdown timer of FIG. 1 operates as follows:

The on/off switch 17 is depressed to energize the micro-computer circuit 30 at which point the CPU 42 generates a display ready message in the form of the word "Ready" on the display panel 14, which is, of course, blank when the unit is unenergized. Thereafter, the user selects a particular time period which is to be counted down by pressing one of the buttons 15 for a pre-programmed period, for example, twenty minutes. By depressing the "select" button 15 for a period of time to be counted down, the numerals for that period, e.g. 20:00, will then be displayed on the read-out display 14. There is no synthetic speech generated or annunciated with the selection of an interval to be counted down.

When it is desired for the actual countdown to commence, the start button 9 is depressed at which time a synthesized vocal sound "twenty, zero, zero" will be generated (or in the case of an alternate selected program, the precise starting time will be similarly annunciated by a synthesized vocal sound). At this point the display time will begin to continuously digitally count down towards a zero time. In accordance with the principles of the invention, the micro-computer circuit 30 is programmed to generate synthetic vocal sounds on the whole elapsed minute until 10 minutes remain in the countdown, at which time the remaining time is synthetically voiced at 15 second intervals until the final minute, at which point it voices every five seconds until fifteen seconds remain, at which time it voices every second until zero, with zero being indicated by a pronounced beep or other sharp sound signal.

At this zero datum point, in accordance an important specific aspect of the present invention, the circuit 30 is programmed immediately, without any pause whatever, to countdown an additional five minute "recall" period. The annunciation of the recall countdown is identical to the annunciated countdown of the final five minutes of the initially selected period, however, the digits of the "recall" register 8 will immediately display "01", indicating that the initial countdown has been completed and that the timer is in its first recall period. The first recall period, when expired, will automatically recycle into a subsequent five minute recall period, at which time the recall register 8 display will indicate "02". The sequence will automatically be repeated up to 99 times, unless the program is terminated by the depression of the on/off switch 17.

The "clock mechanism" by which time is reckoned in the present invention is based upon the knowledge that the performance of certain software operations consume a predetermined amount of time (a "clock cycle") and those clock cycles are controlled by an on-chip oscillator in the central processing unit 42. Advantageously, the synthetic utterances are generated in accordance with a specific aspect of the present invention by the use of "linear coding techniques" rather than phoneme synthesis techniques. This is to produce utterances of the highest possible fidelity and because this technique requires a minimum of internal encoded information storage to produce the required synthesized "utterances".

Referring now to FIG. 3, an alternate preferred embodiment of the present invention is illustrated. The countdown timer 70 of FIG. 3 includes a specially shaped and sized housing 71, which is contoured as shown at its upper and lower edges to fit comfortably into the hand of a user, for example, the housing 71 is approximately 2¾" in width, 3½" in height, and approximately 1¼" in depth. The timer 70 is similar in all respects to the timer 10 shown in FIG. 1, insofar as the internal dedicated micro-computer 30 is concerned, however, the control elements and accessory jacks are arrayed and configured somewhat differently. As shown, a combination on/off-volume control rotary switch 72 is disposed at the front face of the timer 70 for turning the unit on and off and adjusting the volume from low volume to high volume as the switch knob 73 is rotated clockwise. Also disposed on the front face of the timer 70 is a rotatable detent switch 74, the knob 75 of which may be indexed to select a predetermined countdown program. For example, 20 minutes; 15 minutes; 5 minutes; or 3 minutes, as indicated. The timer 70 further includes a contoured "start" push button 76 disposed at an upper shoulder portion 77 of the housing for easy depression by the index finger of a user when the unit is held with the convex lower wall portions 78 in the palm of a user. As is the case for the timer 10 of FIG. 1, the timer 70 of FIG. 3 includes a speaker grille 79 and a LCD time display 80. As will be understood, the operation of the timer 70 is in all respects identical to the operation of the timer 10 and need not be described further. An eye member 81 is secured to the top wall of the housing 71 to support a neck lanyard (not shown) when the timer 70 is worn around the neck. A clip (not shown) for belt mounting of the timer may be affixed to the rear wall of the housing. The timer of FIG. 3 is simply an alternate preferred embodiment of the present invention.

While the present invention has been described with respect to two specific embodiments thereof, it is to be appreciated that certain variations and modifications therein will be apparent to those skilled in the art and that any such variations and modifications are intended to be embraced within the scope of the following claims.

I claim:

1. A minaturized countdown timer comprising (a) central processor unit means for counting down a selectible length of time to a zero time datum;

(b) LCD means for continuously displaying a digital readout of time remaining until said predetermined zero time datum;

(c) voice synthesizer processor means for generating electronic signals corresponding to the digital readout at pre-programmed specific intervals;

(d) loudspeaker means for transducing said electronic signals into audible sounds corresponding to said displayed digital readouts of time remaining at said pre-programmed specific intervals;

(e) recall means for continually, without pause, recycling a predetermined recall time for countdown to said zero time datum upon the expiration of counted down time;

(f) processing means for monitoring the number of cycles said recall means and for continuously displaying the current number of said recall cycle on said LCD means;

(g) intermittent actuating means for activating said voice synthesizing processor means for synthesizing spoken time announcements on the whole minute throughout the countdown; at 15 second intervals of a pre-determined penultimate portion of the countdown; and at each second of the final portion of the countdown.

2. A countdown timer in accordance with claim 1, further including (a) volume control means associated with said loudspeaker means.

3. A countdown timer in accordance with claim 1, further including (a) external jack means associated with said loudspeaker means to accommodate the delivery of said synthesized spoken word signals to an external speaker.

4. A countdown timer in accordance with claim 1, further including (a) circuit board means mounting said central processor means, LCD means, voice synthesizer processor means, and loudspeaker means in cooperative association to form a dedicated microcomputer.

5. A countdown timer in accordance with claim 1, further including (a) compact housing means for protectively encasing said dedicated microcomputer.

6. The countdown timer of claim 5, in which (a) said housing is formed from high-impact resistant thermoplastic.

7. The countdown timer of claim 5, in which (a) said housing is hermetically sealed.

8. The countdown timer of claim 5, in which (a) said housing includes a planar front wall;

(b) said front wall having a window through which the display of said LCD means may be observed;

(c) said front wall includes a grille through which the output of said loudspeaker may be transmitted;

(d) non-porous, sound-conductive membraneous means closing off said grille in watertight manner.

9. The countdown time of claim 8, in which (a) an externally accessible volume control means is associated with said housing;

(b) an externally accessible program selection means is associated with said housing; and (c) externally accessible jack means for said loudspeaker and for recharging an internal power source or powering said timer are associated with said housing.

* * * * *